United States Patent [19]

Waite

[11] Patent Number: 4,864,834

[45] Date of Patent: Sep. 12, 1989

[54] SAFETY LOCK

[76] Inventor: Ronald Waite, 74 Hartzel Road, St. Catharines, Ontario, Canada, L2P 1M8

[21] Appl. No.: 320,497

[22] Filed: Mar. 8, 1989

[51] Int. Cl.[4] ..... E05B 73/00

[52] U.S. Cl. ..... 70/14; 70/57

[58] Field of Search ..... 70/14, 19, 57, 58, 20, 70/31, 35, 38 R, 38 A, 38 B, 38 C, 52, 53

[56] References Cited

U.S. PATENT DOCUMENTS

| | | | |
|---|---|---|---|
| 2,560,624 | 7/1951 | Bartlett | 70/14 |
| 3,667,259 | 6/1972 | Reque | 70/14 |
| 3,703,821 | 11/1972 | Dorey | 70/38 R |
| 3,889,497 | 6/1975 | Tuttle | 70/14 |
| 4,085,599 | 4/1978 | Fischer | 70/14 |
| 4,409,804 | 10/1983 | Sork | 70/14 |
| 4,466,259 | 8/1984 | Osgood | 70/164 |

*Primary Examiner*—Robert L. Wolfe

*Attorney, Agent, or Firm*—Eugene J. A. Gierczak

[57] ABSTRACT

A locking device comprising a hasp rod having two limb portions and a pair of locking plate hingedly connected together along one of said limb portions of said hasp rod, said locking plate adapted for relative swinging movement between an open position where said plates permit access to said other limb of said hasp rod and a closed position where said plates clasp said other limb of said hasp rod between said plates; said plates including aligned passages for receiving padlocks to lockingly secure said plates in said closed position.

14 Claims, 2 Drawing Sheets

SAFETY LOCK

FIELD OF INVENTION

This invention relates to locking devices and more particularly relates to an improved locking device having a pair of plates hingedly connected together and presenting a U-shaped hasp rod and a plurality of aligned passages presented in the plates for receiving a plurality of padlocks.

BACKGROUND TO THE INVENTION

Various locking devices have heretofore been proposed.

For example, U.S. Pat. No. 3,889,497 relates to a multiple-lock securing system including a locking plate which contains openings with locks positioned therein. The bar can be fastened to the locking plate when the locks are positioned in each of the openings. When one of the locks is removed from the locking plate the bar is released which provides access to the secured area.

Moreover, U.S. Pat. No. 3,703,821 relates to a safety lock provided with a number of apertures capable of receiving individual workmens' padlocks and controlled by a master key so that the workmen may work on a machine with the knowledge the that the power cannot be switched inadvertently by another workman.

Moreover, U. S. Pat. No. 4,466,259 discloses a locking device for locking a cap onto the filling neck of a tank.

Another device described in U.S. Pat. No. 4,085,599 teaches a padlock adapter assembly comprising a pair of identically stamped plates each having a pair of spaced passages aligned with a respective passage in the other plates to form a pair of aligned passages for receiving a respective padlock shackle.

Finally, U.S. Pat. No. 3,667,259 discloses another variation of a safety lock.

Many of such locking devices have been designed to receive a plurality of padlocks to be individually opened by a number of different persons or workmen so that the secured area which may include a fuse box, restricted area or the like, may only be entered once all of said padlocks have been removed.

In some other cases, such locking devices are provided so that if a particular person such as a mechanic, electrician or maintenance man is repairing a machine such locking device is secured to the machine so that another workman may not inadvertently start same while the other is maintaining said machine.

Such devices present relatively complicated structure which have limited utility particularly since some of the locking devices can be pried open.

It is an object of this invention to provide an improved locking device which substantially reduces deliberate tampering of said locking device.

The broadest aspect of this invention relates to a locking device comprising; a hasp rod having two limb portions and a pair of locking plates hingedly connected together along one of said limb portions of said hasp rod, said plate adapted for relative swinging movement between an open position where said plates permit access to said other limb of said hasp rod, and a closed position where said locking plates clasp said other limb of said hasp rod between said plates, said plates including aligned passages for receiving a plurality of padlocks to lockingly secure said plates in said closed position.

It is another aspect of this invention to provide a locking device comprising; a hasp rod having a curved rod portion presenting first and second cylindrical limbs extending from the ends of said curved rod portion; a pair of rectangular locking plates hingedly connected together to said first limb, said plates adapted for relative swinging movement between an open position where said plates permit access to said second limb of said hasp rod, and a closed position where said plates clasp said second limb of said hasp rod between said plates, said plates including aligned passages adapted to receiving a plurality of padlocks to lockingly secure said plates in said closed position.

DESCRIPTION OF DRAWINGS

These and other objects and features shall now be described in relation to the following drawings.

DESCRIPTION OF THE INVENTION

Like parts shall be given like numbers throughout the figures.

Figure 1:
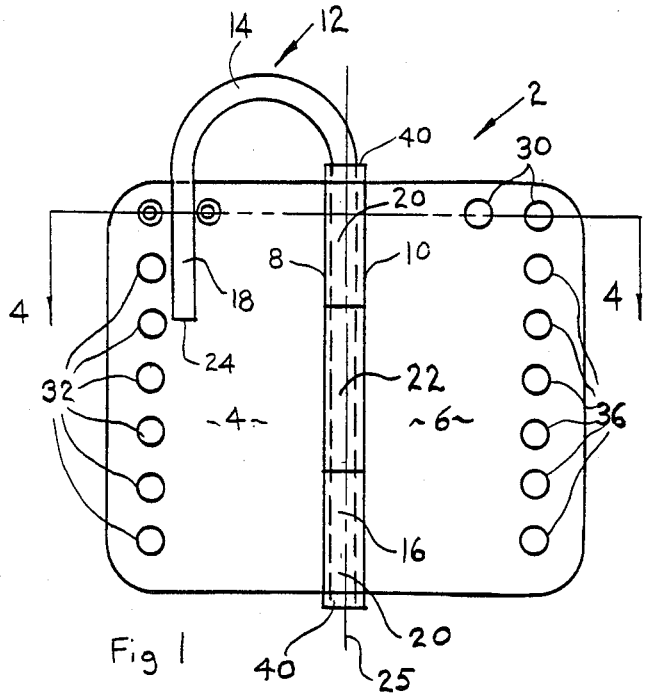
FIG. 1 is a view of said locking device in an open position.
Figure 4:
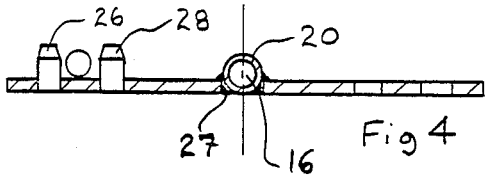
FIG. 4 is a cross-sectional view taken along the line 4—4 of FIG. 1.

FIG. 1 discloses the locking device 2 having a pair of locking plates 4 and 6 which are hingedly connected along adjacent sides 8 and 10 of locking plates 4 and 6.

The locking plates are generally rectangular in profile and may be stamped in a manner well known to those persons skilled in the art. Such locking plates may be comprised of plate steel so as to enhance the strength characteristics of said plates.

The locking device 2 also includes a hasp rod 12 which is comprised of a rod which is bent so as to present a curved or U-shaped portion 14 presenting a first limb portion 16 and a second limb portion 18 extending from the ends of said curved or U-shaped portion.

The locking plates 4 and 6 are hingedly connected at the adjacent ends 8 and 10 to the first cylindrical limb portion 16 as best illustrated in FIGS. 1.

The hinged portion of locking plates 4 and 6 may comprise of a cylindrical tube 20 and 22 which is either welded 27 to locking plates 4 and 6 respectively or may comprise of plate steel which is rolled in a manner well known to those persons skilled in the art to present a hinge portion.

FIG. 1 best illustrates that the first limb 16 is longer in length than the second limb 18. The first limb 16 is substantially enclosed in the hinge portions 20 and 22 of plates 4 and 6.

Figure 2:
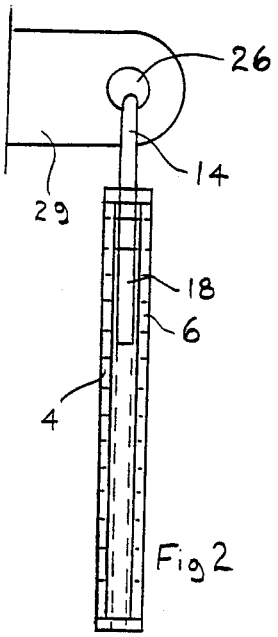
FIG. 2 is an end elevational view of said locking device in a closed position where said hasp rod is secured to a restricted area.
Figure 3:
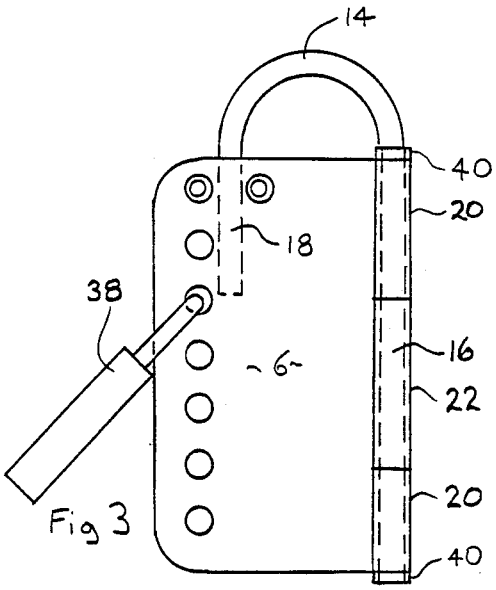
FIG. 3 is a side elevational view of said locking device in a closed position.

The plates 4 and 6 are adapted to swing about axis 25 of first limb 16 between an open position illustrated in FIG. 1 and a closed position as illustrated in FIGS. 2 and 3.

In the open position as illustrated in FIGS. 1 the plates 4 and 6 permit access to said second limb 18 so that the end 25 of second limb 18 may be inserted into an appropriate aperture 26 of a restricted area such as the latch on a fuse box or door to a restricted area so as to retain such latches in the curved portion 14 of hasp rod 12 as illustrated in FIG. 2. It should be noted that when the locking plates 4 and 6 are in the open position the hasp rod 12 may freely swing between said plates 4 and 6 so that the second limb 18 may either contact the locking plate 4 as illustrated in FIG. 1 or may contact locking plate 6 (not shown). In this way the hasp rod 12 may be easily secured to any desired restricted access device.

Once said hasp rod 12 is secured to the desired location the locking plates 4 and 6 may be swingingly moved to the closed position so as to clasp and embrace the second limb between locking plates 4 and 6 as best illustrated in FIGS. 2 and 3.

One of the locking plates 4 presents a pair of posts 26 and 28 extending generally outwardly therefrom which are adapted to receive the second limb 18 of hasp rod 12 therebetween so as to resist anyone attempting to pry or pull the second limb away from between locking plates 4 and 6 in the closed position. Furthermore, the other locking plate 6 presents apertures 30 which are adapted to register with the posts 26 and 28 as best illustrated in FIG. 3. The posts 26 and 28 may be secured to plate 4 by a variety of means including welding or force fit.

Plates 4 and 6 present a plurality of passages 32 and 36 which are aligned so as to permit padlocks 38 to be received by the locking device 2 when the locking plates 4 and 6 are in the closed position as best illustrated in FIG. 3. A plurality of padlocks may be received by each of the holes 32 and 36.

The second limb 18 is contained between the locking plates 4 and 6 in the closed position intermediate the aligned holes 32 and 36 and hinges 20 and 22.

FIrst limb 16 presents retaining means 40 which comprise of sections of metallic tubes that are welded to first limb 16 so as to prevent the plates 4 and 6 from being removed from the hasp rod.

The operation of the locking device shall now be described.

The locking device is adapted to be swingingly moved about axis 25 to an open position as illustrated in FIG. 1 whereby an operator may secure the second limb 18 onto a latch 28 of a restricted area. Thereafter the locking plates 4 and 6 are swingingly moved to the closed position as illustrated in FIGS. 2 and 3 whereby the second limb is adapted to be clasped between locking plates 4 and 6 and received between posts 26 and 28 which posts 26 and 28 register with apertures 30 as illustrated in FIG. 3. Thereafter a plurality of padlocks may be individually secured by a plurality of workmen onto passages 32 and 36. Thereafter in order to gain access to the restricted area each padlock 38 must be removed by the individual workmen. Moreover, such locking device 2 may be applied to a power source by a first workman so as to prevent any other person from inadvertently starting the power of a machine particularly when the first workman is still working on same.

Although the preferred embodiment as well as the operation and use have been specifically described in relation to the drawings, it should be understood that variations in preferred embodiment can be achieved by a man skilled in the art without departing from the spirit of the invention. Accordingly, the invention should not be understood to be limited to the exact form revealed by the drawings.

I claim:

1. A locking device comprising: hasp rod means having two limb portions; and a pair of locking plates hingedly connected together along one of said limb portions of said hasp rod means, said locking plates adapted for relative swinging movement between an open position where said plates permit access to said other limb of said hasp rod means, and a closed position where said locking plates clasp said other limb of said hasp rod means between said plates; said plates including aligned passage means for receiving padlock means to lockingly secure said plates in said closed position.

2. A locking device as claimed in claim 1 wherein said hasp rod means include a U-shaped hasp portion connected to said limb portions.

3. A locking device as claimed in claim 2 wherein one of said limbs is longer than said other limb.

4. A locking device as claimed in claim 3 wherein said pair of locking plates are hingedly connected together to said longer limb.

5. A locking device as claimed in claim 4 wherein said aligned passage means are presented in a region remote from said limb portions.

6. A locking device comprising:

(a) a hasp rod having a curved rod portion and first and second
cylindrical limbs extending from the ends of said curved rod
portion;

(b) a pair of rectangular locking plates hingedly connected together to said first limb, said plates adapted for relative swinging movement between an open position where said plates permit access to said second limb of said hasp rod, and a closed position where said plates clasp said second limb of said hasp rod between said plates, said plates including aligned passage means for receiving padlock means to lockingly secure said plates in said closed position.

7. A locking device as claimed in claim 6 wherein adjacent edges of said rectangular plates are hingedly connected to said first limb.

8. A locking device as claimed in claim 7 wherein said aligned passage means are presented in a region remote from said hinged connection of said plates to said first limb.

9. A locking device as claimed in claim 8 where said aligned passage means present a plurality of holes disposed generally in a parallel row along an edge of said plates opposite said hinged connection of said plates to said first limb.

10. A locking device as claimed in claim 9 wherein said second limb is adapted to be clasped between said second plates intermediate said holes and said first limb.

11. A locking device as claimed in claim 10 wherein said first limb is longer than said second limb.

12. A locking device as claimed in claim 11 wherein one of said plates presents a pair of post means extending generally outwardly therefrom and adapted to receive said second limb between said post means when said plates are in said closed position.

13. A locking device as claimed in claim 12 wherein said other plate includes aperture means adapted to register with said post means when said plates are in said closed position.

14. A locking device as claimed in claim 13 wherein said first limb includes retaining means for retaining said hinged connected plates to said first limb.

* * * * *